US005943740A

United States Patent [19]

Slavik et al.

[11] Patent Number: 5,943,740

[45] Date of Patent: Aug. 31, 1999

[54] COMBING MACHINE WITH AN AUTOLEVELLER DRAFTING ARRANGEMENT

[75] Inventors: Walter Slavik, Fehraltorf; Gerd Gschliesser, Winterthur; Viktor Pietrini, Wiezikon bei Sirnach; Thomas Sigrist, Winterthur; Roland Fischer, Stafa, all of Switzerland

[73] Assignee: Rieter Machine Works, Ltd., Winterthur, Switzerland

[21] Appl. No.: 08/828,006

[22] Filed: Mar. 27, 1997

[30] Foreign Application Priority Data

Apr. 2, 1996 [CH] Switzerland ..... 0854/96

[51] Int. Cl.[6] ..... D01H 5/32

[52] U.S. Cl. ..... 19/239; 19/243; 19/260; 19/159 R

[58] Field of Search ..... 19/236, 239, 240, 19/243, 258, 260, 288, 290, 157, 159 R, 150, 65 A

[56] References Cited

U.S. PATENT DOCUMENTS

| | | | |
|---|---|---|---|
| 4,266,324 | 5/1981 | Hasegawa et al. | 19/239 |
| 4,974,296 | 12/1990 | Vidler | 19/239 |
| 5,161,284 | 11/1992 | Leifeld | 19/243 |
| 5,384,934 | 1/1995 | Dammig | 19/239 |
| 5,428,870 | 7/1995 | Rutz et al. | 19/240 |
| 5,463,556 | 10/1995 | Denz | 19/236 |

*Primary Examiner*—Michael A. Neas
*Attorney, Agent, or Firm*—McAulay Nissen Goldberg Kiel & Hand, LLP

[57] ABSTRACT

The invention relates to an apparatus for forming a sliver with a first regulated drafting arrangement (10) with several pairs of rollers (11, 12, 14) for the regulated drafting of the fibre mass (8) supplied to the drafting arrangement, with the fibre fleece (28) delivered by the drafting arrangement being joined and supplied to a measuring member (32) from where the measured fibre material is thereafter supplied to a second drafting arrangement (40) and with the autoleveller device (35, 52, 21) of the first drafting arrangement (10) intervening in a regulating manner in the drive of the first drafting arrangement (40) in order to compensate fluctuations in mass on the basis of the signals issued by the measuring member (32) by including a predetermined setpoint value.

Various regulating and control devices are known in practice in order to obtain a high-quality sliver. In order to detect and compensate short-wave and long-wave fluctuations in mass in a simple way an apparatus is proposed, with the second drafting arrangement (40) being provided with a control device (35, 50, 48) for compensating short-wave fluctuations in mass, which device intervenes in a controlling manner in the drive of the second drafting arrangement (40) on the basis of the signals issued by the measuring member (32).

6 Claims, 5 Drawing Sheets

COMBING MACHINE WITH AN AUTOLEVELLER DRAFTING ARRANGEMENT

The invention relates to an apparatus and a method for forming a sliver with a first regulated drafting arrangement with several pairs of rollers for the regulated drafting of the fibre mass supplied to the drafting arrangement, with the fibre fleece delivered by the drafting arrangement being joined and supplied to a measuring member from where the measured fibre material is thereafter supplied to a second drafting arrangement and with the autoleveller device of the first drafting arrangement intervening in a regulating manner in the drive of the first drafting arrangement in order to compensate fluctuations in mass on the basis of the signals issued by the measuring member by including a predetermined setpoint value.

In a spinning line for processing fibres various machines are present in which a sliver is formed as an end product. Such machines are the carding machine, drafting arrangement and the combing machine, for example.

In order to improve the processing of the thus formed sliver for a subsequent machine which processes the sliver it is advantageous if the sliver of the respective machine can be supplied with an even mass and without interruption.

That is why there are various solutions from the state of the art, whereby autoleveller devices for levelling out the sliver evenness are used in the respective machines.

Such autoleveller devices are applied in a known manner in particular in the area of the draw frame such as in EP-A2 176 661 and U.S. Pat. No. 3,440,690. Also in the field of the combing machine it is known from EP-A1 376 002 and from JP-OS-53-86841 to provide an autoleveller device for the drafting arrangement installed in the combing machine.

The increasingly rising production rates automatically lead to an increase in the production speed of the fibre material or the conveying speed of the formed end product (e.g. of a sliver).

This means that the requirements placed on the described autoleveller devices have continuously risen. The requirements placed on the measuring members for measuring the fibre masses for detecting short- and long-wave fluctuations in mass have also risen, for example. This was caused on the one hand by the aforementioned higher conveying speeds and on the other hand by the increasingly larger supplied masses which are to be scanned and also by the risen requirements with respect to the quality of the end product.

The slivers formed in the described machines are usually deposited in cans by way of special coiling apparatuses which are then transported either manually or automatically to a machine downstream for further processing.

There is the requirement, on the one hand, of the formation of an even sliver and, on the other hand, of depositing an uninterrupted sliver. A sliver breakage in a can creel leads to additional and undesirable standstill periods in the subsequent processing process.

With the existing and known autoleveller devices in drafting arrangements it is possible to achieve favourable results with respect to the evenness of the formed sliver. However, these results are only partly adequate with respect to the risen requirements concerning quality and a desired coiling. Particularly the piecing positions arising during the detaching and piecing process in the combing machine can be levelled only with a considerable amount of work and partly with several drafting passages.

The invention now has the object of providing an apparatus and a method for forming a sliver which with respect to its evenness is of high quality and which ensures the coiling of an uninterrupted sliver.

In this respect it is proposed that the second drafting arrangement be provided with a control device for compensating short-wave fluctuations in mass which intervenes in the drive of the second drafting arrangement on the basis of the signals issued by the measuring member.

The measuring member, which is arranged downstream of the first drafting arrangement, is supplied with a reduced fibre mass for the measuring process. In this way it is possible to also use measuring members for detecting short-wave fluctuations in mass, e.g. for detecting piecing positions in the combing machine, which can also detect the fibre mass with a non-mechanical device. This means that commercially available, pure electronic or piezo-electronic sensors can be used, which on the basis of the reduced fibre mass can carry out a very precise detection of occurring fluctuations in mass. The fluctuations in mass which occur on a short-term basis can be detected better after the first drafting arrangement because they are displaced over the length in a respective manner by the first drafting process. A fluctuation in mass shall be mentioned here as an example which occurs as a consequence of the piecing in the combing machine. The piecing usually occurs every 30 mm. This means that if the drafting arrangement operates with a drafting ratio of 5:1 for example, this distance is extended between the mass fluctuations to 150 mm as a result of the soldering.

As a result of the reduced mass which is supplied to the measuring member, irregularities even in the region of the supplied fibre mass can be detected better and more precisely. In this way it is possible, by issuing a precise measurement signal to a control device for a further drafting arrangement downstream, to supply precise values for controlling the fibre mass supplied to the second drafting arrangement, e.g. in form of a sliver. As the fibre mass to be controlled is relatively small at the second drafting arrangement, the control dynamics can be kept to a low value. This means that the control of a smaller fibre mass is easier to handle or perform with respect to the dynamic control interventions than would be the case for a large fibre mass. Moreover, only one measuring member is required in the proposed arrangement in order to perform, on the one hand, the regulation of the first drafting arrangement and, on the other hand, the control of the second drafting arrangement. This allows for a very compact and simple arrangement.

It is proposed further that the pair of output rollers of the first drafting arrangement is regulated. This allows compensating the fluctuations in the transport caused by the first control intervention by a subsequent coupling of the drives downstream (second drafting arrangement, coiling devices) without having to correct the drives of the delivery devices and without any additional buffer storage.

Preferably, the pair of output rollers of the second drafting arrangement is controlled on the basis of the delivered measurement signal.

It is proposed further that the sliver formed in the second drafting arrangement is deposited in a storage means by way of the coiling device and the drive of the coiling device and the drive of the pair of input rollers of the second drafting arrangement are drivably coupled with the drive of the pair of output rollers of the first drafting arrangement.

This ensures a simple device which enables the secure correction of the devices arranged downstream of the first drafting arrangement without buffer storage. As only short-wave interventions are required in the second drafting arrangement, no intermediate storage means is required between the second drafting arrangement and the coiling device.

In order to provide an additional monitoring of the sliver with respect to the fibre mass, it is proposed that a further measuring member be provided in the region between the second drafting arrangement and the coiling apparatus.

It is proposed further that the autoleveller device is provided with a timing element through which the drive of the drafting arrangements, the coiling apparatus and the feed devices for delivering the fibre mass is stopped when the deviation of the mass determined by the first measuring member with respect to a predetermined setpoint value exceeds a certain tolerance limit over an interval which is larger than a predetermined time segment. This ensures, for example, that during the failure of a sliver supplied to a first drafting arrangement over a defined period of time it is possible to compensate this failure by means of the autoleveller device. After a certain period of time or after a predetermined interval this fault should be eliminated by a lower supply of fibre mass. This means that the missing sliver should be corrected. If this is not the case the machine is stopped by way of the timing element in order to indicate to the operator a faulty delivery and to allow the correction of the missing sliver.

In the case of the failure of one or several slivers supplied to the first drafting arrangement or the occurrence of windings within the first drafting arrangements, fluctuations in mass can occur which can no longer be compensated by the autoleveller drafting arrangement downstream. Such malfunctions are recognized by known monitoring devices in the drafting arrangement or the area of the delivery devices and transmitted to a control device. After the stop of the machine has occurred, an apparatus can be controlled or actuated through this control device for discharging the fibre material delivered by the first drafting arrangement in the normal conveying direction. The feed device located upstream of the drafting arrangement is started simultaneously with the first drafting arrangement after the elimination of the error or fault. In this way the portion of the fibre material with the missing mass can be divided out until the desired fibre mass is present again. During this separation process of the reduced fibre mass the units (second drafting arrangement, coiling apparatus, etc.) located downstream of the first drafting arrangement are stopped. This means that the end of the sliver supplied to the autoleveller drafting arrangement is not conveyed during the separating process and is available in a sufficient length for the piecing of a new sliver end. As soon as a sliver with sufficient mass can be formed it is joined with the stationary trailing sliver. Thereafter the entire unit is put back into motion again.

It is therefore proposed further that the an apparatus for piecing a new sliver end to the trailing sliver end is arranged downstream of the apparatus for discharging the fibre material and the drive of the drafting arrangement following the first drafting arrangement and of the coiling apparatus is at least temporarily separated from the drive of the first drafting arrangement. This may occur through a coupling, for example, in order to separate and stop the drive devices situated downstream of the first drafting arrangement. When using electromotive individual drives, this shutdown is made through signals issued in a respective manner by a control device. The re-supply of the fibre mass to the first drafting arrangement is monitored during the separation process, so that the time is recognized at which the normal fibre mass is present for introduction into the normal operation.

It is proposed further that downstream of the first drafting arrangement there are formed at least two slivers which prior to the entrance in the measuring member downstream are joined into one sliver. The piecing apparatus is arranged in such a way that each of the individual slivers can be pieced in an offset manner with respect to the conveying direction. In this way the two piecing positions do not meet during the joining of the two slivers. This means that the fluctuations in the thickness in the area of the piecing which may occur during the piecing process are mutually displaced so that they cannot add up. The fluctuation in mass which may occur during the piecing process is thus halved with respect to the joined sliver.

By using individual electrical drives for the drafting arrangements or the coiling apparatus it is possible to provide a simple separation of certain drive zones in order to separate faulty fibre mass from the process.

Further advantages of the invention are explained in closer detail by reference to the enclosed embodiments, wherein.

Figure 1:
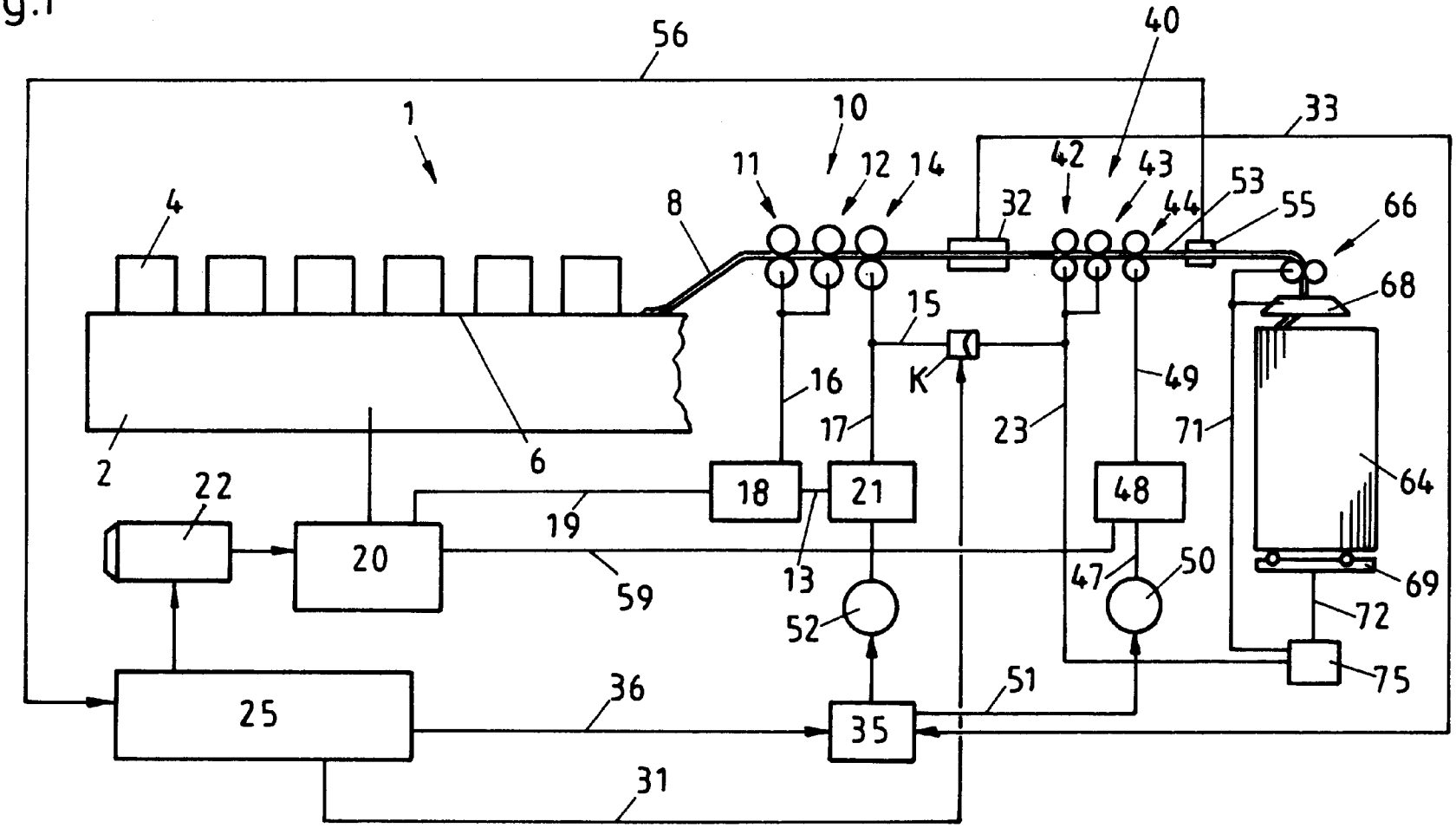
FIG. 1 shows a schematic side view of a combing machine with the arrangement proposed in accordance with the invention.

FIG. 1 shows the longitudinal part 2 of a combing machine 1 on which rest wound laps 4 for rolling off and combing out by combing devices which are located downstream. Usually there are eight such laps on a combing machine for rolling off. The slivers formed in the individual combing heads are joined on a delivery table 6 on the longitudinal part 2 into a sliver compound 8 and supplied in the conveying direction F to a first drafting arrangement 10. The slivers supplied by the individual combing heads are usually provided with a count or sliver mass of 8 g/m, as a result of which there is a sliver compound 8 made of eight slivers with a mass of 64 g/m. This sliver mass is subjected in the drafting arrangement 10 to a draft of five times, for example, as a result of which the fibre mass delivered by drafting arrangement 10 is reduced to approx. 12 g/m. The drafting arrangement 10 is equipped with a known preliminary draft between the pairs of drafting rollers 11 and 12. The main draft occurs between the pairs of drafting rollers 12 and 14. The drafting ratios (preliminary draft) between the drafting rollers 11 and 12 are set fixedly, whereas the main draft between the rollers 12 and 14 is regulated by an autoleveller device according to the signal of a measuring member 32 provided downstream.

The drafting rollers 11 and 12 are driven by a schematically shown drive string 16 by a gear 18 with fixed transmission ratios. The gear 18 is connected to a main gear 20 through the drive string 19, with the main gear being driven by a motor 22. The motor 22 is controlled by a control unit 25. The output rollers 14 of the drafting arrangement 10 are driven through a transmission having a drive string 17 which is driven by a differential gear 21 which is connected with gear 18 via a drive string 13. To perform the control intervention (change of the main draft) the differential gear 21, which is driven via the drive string 13 with a constant rotational speed, can be overridden by a servo-motor 52.

The servo-motor 52 receives its control pulses from a control unit 35 which is controlled on the basis of a predetermined setpoint value in comparison with the actual value (fibre mass) determined by the measuring member 32. The fibre fleece 28 exiting from the first drafting arrangement 10 is joined into a sliver 30 and supplied to the measuring member 32. This is shown in particular in the representation in FIG. 2, with the formation of the sliver 30 before the measuring member 32 occurring by the condensation of the fibre fleece 28 over a guide element 29.

The cross section of the formed sliver 30 can have a round, an oval or also a rectangular shape. Other shapes are also possible.

The measuring member 32 can either be of mechanical design (grooved roller) or function on an electronic scanning basis. Such measuring members are already known in various embodiments from the state of the art. The signal of the measuring member 32 is supplied to the control unit 35 via a path 33, which unit 35 is connected to the control unit 25 via a path 36. The control unit 35 could also be integrated directly in the control unit 25.

The sliver 30 coming from the measuring member 32 is supplied to a drafting arrangement 40 which is provided with a control device. The drafting arrangement 40 consists of a pair of input rollers 42 which performs a fixedly set preliminary draft with a pair of rollers 43. The drive of these two pairs of rollers is effected through the differential gear 21 by way of a drive string 15, a coupling K and a drive string 23. The detailed representation of respectively required mechanical gear ratios was omitted for reasons of clarity of the representation. As a result of this drive connection it is ensured that the rotational speed of the pair of output rollers 14 of the first drafting arrangement 10 and of the pair of input rollers 42 of the drafting arrangement 40 are mutually adjusted so that both pairs of rollers rotate with approximately the same circumferential speed. This means that between these two pairs of rollers 14 and 42 there is a mechanical coupling which ensures synchronism. A certain stretching draft between the two pairs of rollers 14 and 42 can be present. A transmission having a differential gear 48 which is driven by gear 20 via a drive string 59, drives the pair of output rollers 44 of the drafting arrangement 40 via a drive string 49. The differential gear 48 is connected with a servo-motor 50 via a drive string 47 to perform a control intervention, which motor can intervene in the drive of the differential gear 48 in a regulating or controlling manner. This means that the drive is corrected or overridden in a respective manner via the drive string 59.

The servo-motor 50 receives its control pulses via path 51 from the control unit 35. The aforementioned processing of the measurement signal of the measuring device 32 is also performed by this unit. It is tried to correct the short-wave fluctuations in mass (e.g. pieced positions) and to compensate the deviations within a predetermined tolerance range. This means that it is aimed at the production of an even sliver. The control interventions are made in the event that the determined peaks of the short-wave fluctuations in mass exceed the predetermined tolerance range. The control signal is then issued by the control unit 35 to the servo-motor 50 via path 51. The sliver 53 supplied by drafting arrangement 40 is then guided through a measuring member 55 which is connected with the control unit 25 via a path 56. In this measuring member a monitoring of the fibre mass of the sliver is carried out again and the machine is turned off when a deviation from a setpoint value is determined. Such measuring members are also already known and can be taken from the state of the art. The sliver 53 is thereafter supplied to a coiling apparatus and coiled in a storage means such as a can 64 by means of respective units. These units, for example, are a pair of calender rollers 66 which deliver the sliver to a funnel wheel 68. The sliver reaches can 64 from the funnel wheel and is deposited there in form of loops. The pair of calender rollers 66, the funnel wheel 68 and a can drive plate 69 are driven via the drive strings 71 and 72 and by a transmission gear 75. The transmission gear 75 is connected with the gear 21 via the drive strings 23, 15 and 17 and via the coupling K. As a result of this drive connection the drive of the coiling apparatus 66, 68, 69 follows the changeable rotational speed of the differential gear 21. This allows a continuous coiling of the sliver without having to attach any complex intermediate storages which are susceptible to faults.

As was already described above, the sliver formed after the drafting arrangement 10 has a fibre mass of approx. 12 g/m. The draft in the following autoleveller drafting arrangement 40 is arranged in such a way that the sliver deposited in the can 64 has a mass of approx. 5 g/m.

Figure 2:
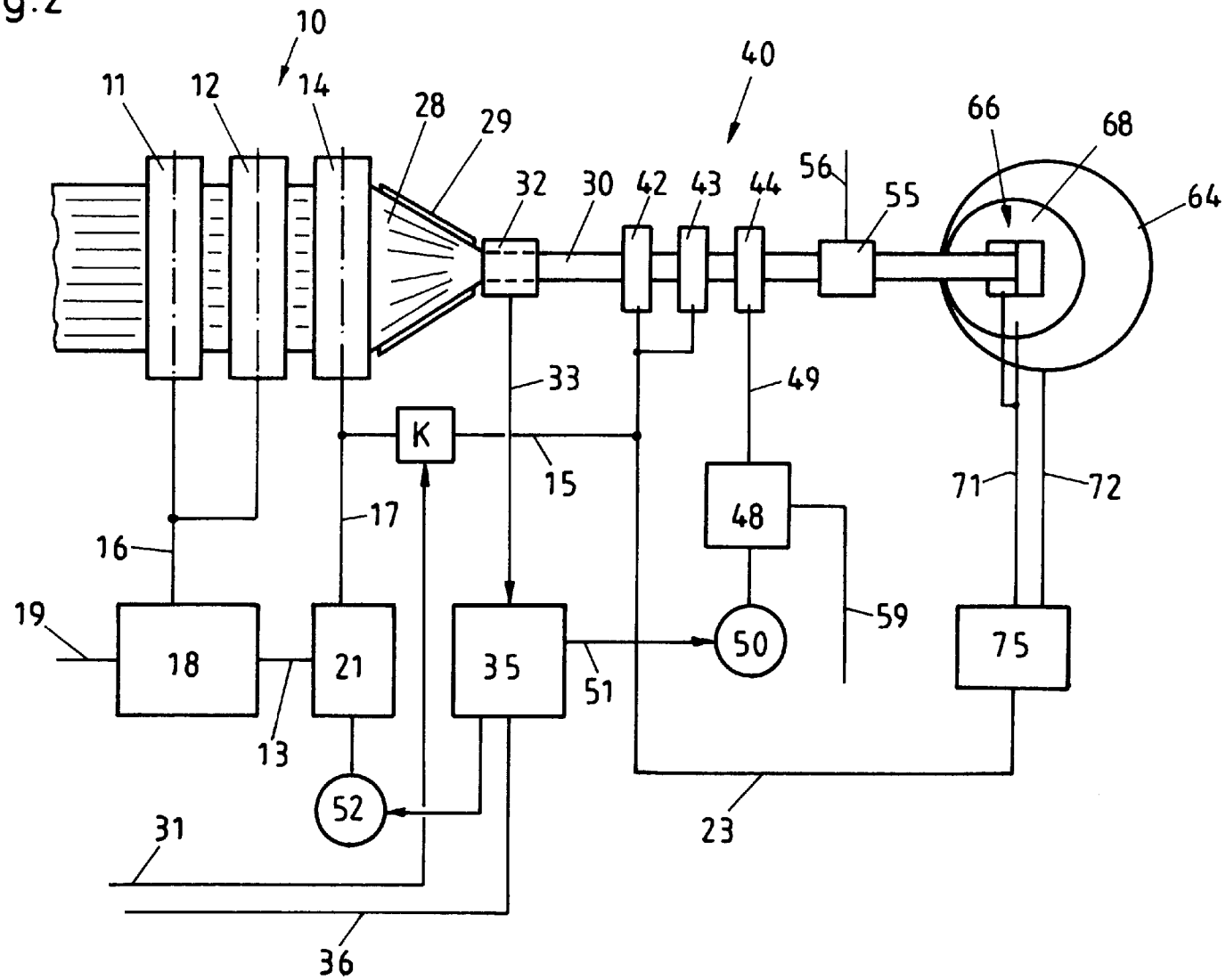
FIG. 2 shows an enlarged partial view of the drafting arrangement devices in a top view pursuant to FIG. 1.
Figure 3:
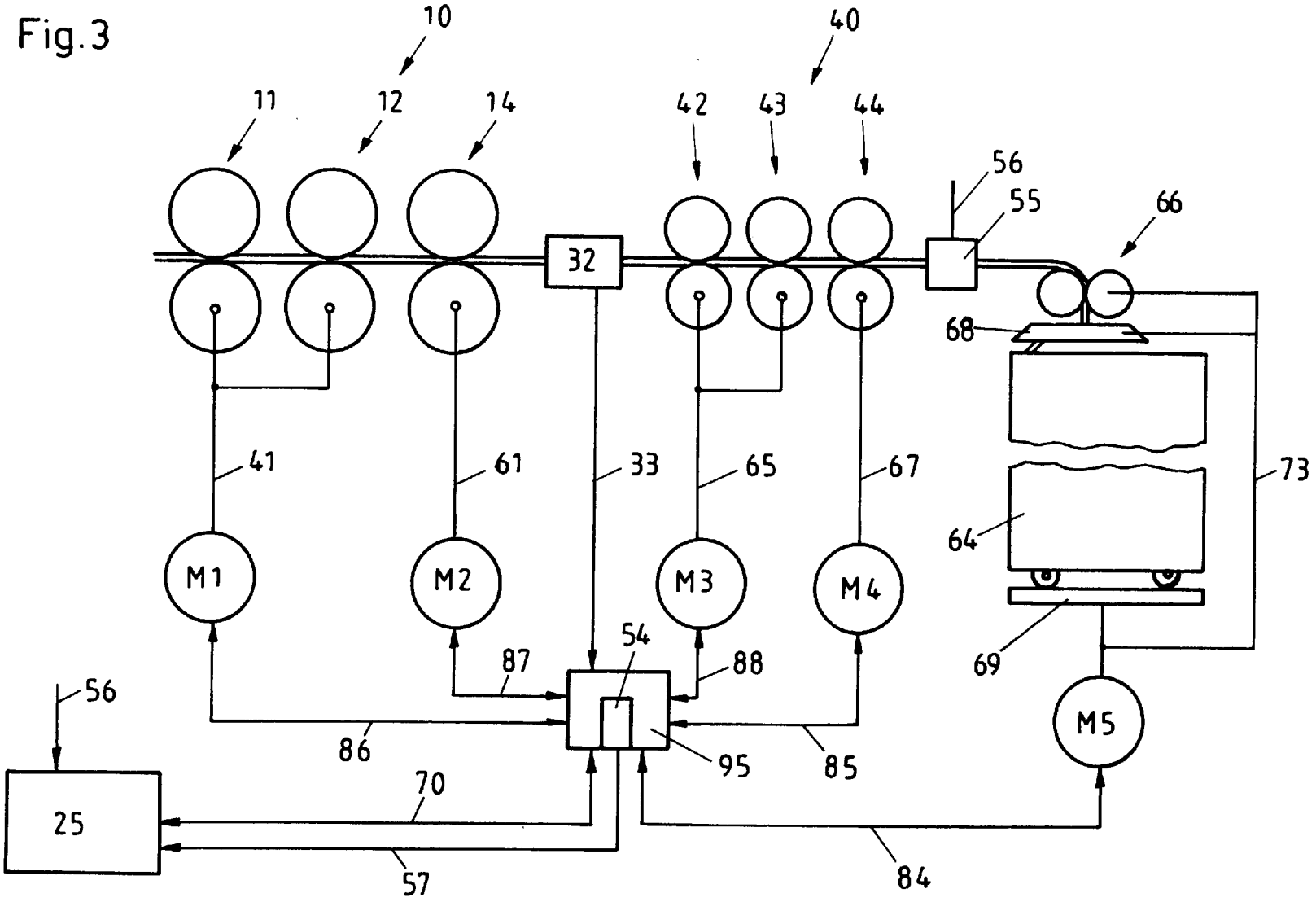
FIG. 3 shows a schematic side view in accordance with FIG. 2 with an embodiment of a drive device.

FIG. 3 shows a side view according to the embodiment of FIG. 2, with the drive system being altered as compared with the embodiment in accordance with FIG. 2, however. The drafting arrangement 10 is driven by the electromotors M1 and M2 via drive strings 41, 61, with a fixed transmission being present in the drive string 41 between the individual pairs of rollers 11 and 12 by interposing a transmission gear (not shown). The motor M1, which runs with a continuous speed, receives its control pulses by a control unit 95 which is connected with the central control unit 25 via path 70. The motor M2 is arranged as a servo-motor and is controlled by the control unit 95 via path 87 on the basis of a setpoint/actual value comparison with the measurement signal of the measuring member 32. The measuring member 32 is connected via the path 33 with the control unit 95 and determines the mass of the supplied fibre material.

The measurement signal issued to the control unit 95 also shows short-wave deviations in respect of sliver evenness, which, as was already described, are compensated by the second drafting arrangement 40. In the second drafting arrangement 40 the two pairs of input rollers 42 and 43 are driven with the respective transmission (not shown) via the drive string 65 by an electromotor M3, which receives its control pulses from the control unit 95 via the line 88. An adjustment of the rotational speed is performed in particular between the motors M2 and M3 in order to adjust the circumferential speeds of the pair of output rollers 14 with the circumferential speeds of the pair of input rollers 42. The motor M4 is designed as a servo-motor and acts through the drive string 67 on the output rollers 44. On the basis of the signal supplied via the path 33 by the measuring member 32 in conjunction with a predetermined tolerance range a respective control signal is supplied via path 85 for controlling the servo-motor M4. In this way it is possible to change the main draft between the pairs of rollers 43 and 44 in a respective manner and the evening of the sliver mass can be achieved.

As is known, the respective motors M1 to M4 can be provided with sensor devices (not shown) for scanning the rotational movement of the motor shaft so as to ensure an adjustment of the rotational speeds between the motors. An electromotive individual drive M5 is additionally provided for the coiling devices 66, 68 and 69 which is controlled via the path 84 by control unit 95. The rotational speed of the motor M5 can be adjusted or corrected to the regulated rotational speed of the motor M2 by the control unit 95.

A timing element 54 is schematically indicated in the control unit 95 which is connected through the path 57 with the control unit 25. If the deviation of the mass exceeds a specific value of the actual value measured by the sensor 32 with respect to a predetermined setpoint value over a specific time interval, the machine is stopped by the control unit 25 in order to eliminate the malfunction. A signal is emitted to notify the operator.

Figure 4:
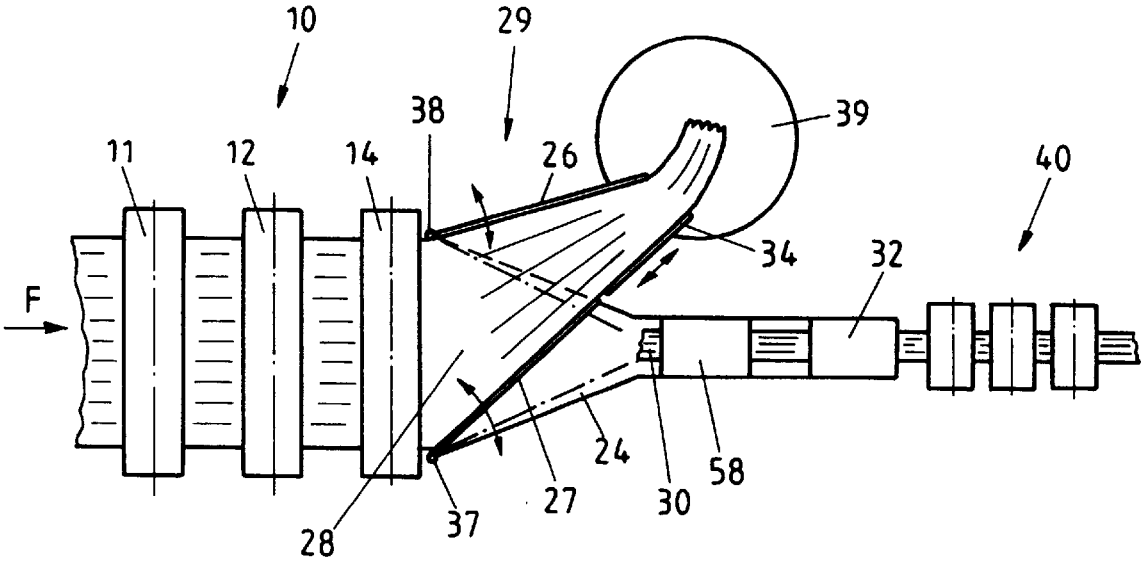
FIG. 4 shows a embodiment pursuant to FIG. 2 with a separation apparatus for the fibre material.
Figure 6:
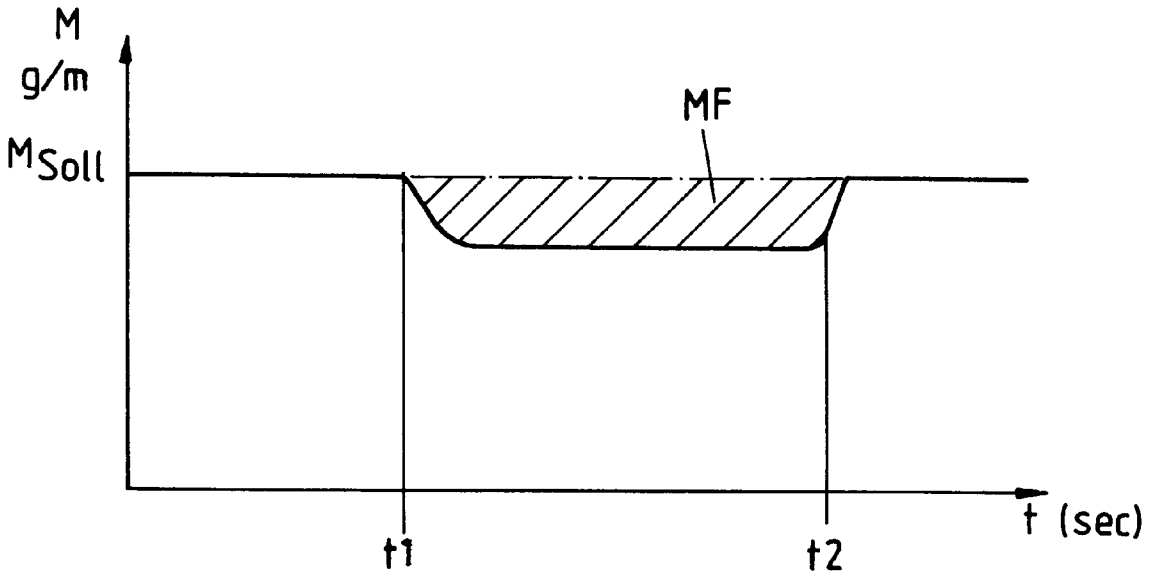
FIG. 6 shows a diagram for representing the delivered fibre mass.

FIG. 4 shows a modification of the embodiment pursuant to FIG. 2, with the guide element 29 being provided with two swivellable plates 26 and 27 downstream of the drafting arrangement 10 and the pair of output rollers 14. The plates are arranged swivellable about the swivel axes 37 and 38. The representation of an actuating device for performing the swivelling movement was omitted for reasons of clarity. In this arrangement a displaceable guide plate 34 is additionally arranged which allows in the position as shown in FIG. 4 a transversal discharge of the fibre fleece 28 delivered by the drafting arrangement 10 into a container 39 with the plates 26 and 27. A guide plate 24 is attached below the plates 26, 27. This device allows separating from the normal processing process the partial segment of the fibre fleece 28 which is provided with a reduced fibre mass MF. This is shown schematically in the diagram pursuant to FIG. 6, with a reduction in mass occurring at time t1, for example. This reduction in mass can originate by the failure of one or several slivers. After the recognition of the reduction in mass, which can also be made in the feed device for example, the machine is stopped and the malfunction is eliminated. Thereafter the feed device to the drafting arrangement 10 can be started again including the drafting arrangement 10. The faulty partial segment between time t1 and t2 is discharged through the guide element 29 in the position as shown in FIG. 4. During this discharging process the drafting arrangement 40 and the coiling devices downstream are stopped, as a result of which the rear end of the sliver 30 is ready at a standstill in a piecing apparatus 58. In this process coupling K is open, which is connected with the control unit 25 via path 31, as a result of which the drive of the drafting arrangement 40 and the coiling apparatus 66, 68 and 69 is stopped. At the time t2, at which the desired fibre mass is present (setpoint), the plates 26, 27 and 34 are pivoted back again into the position shown in the dot-dash line and thus a sliver is supplied to the measuring member 32 and the piecing apparatus 58. As soon as the piecing process of the forward sliver end has been performed manually or automatically with the rear sliver end 30, the drafting arrangement 40 and the subsequent devices are put back into operation again by the closing of coupling K, which again ensures a standard working process.

Figure 5:
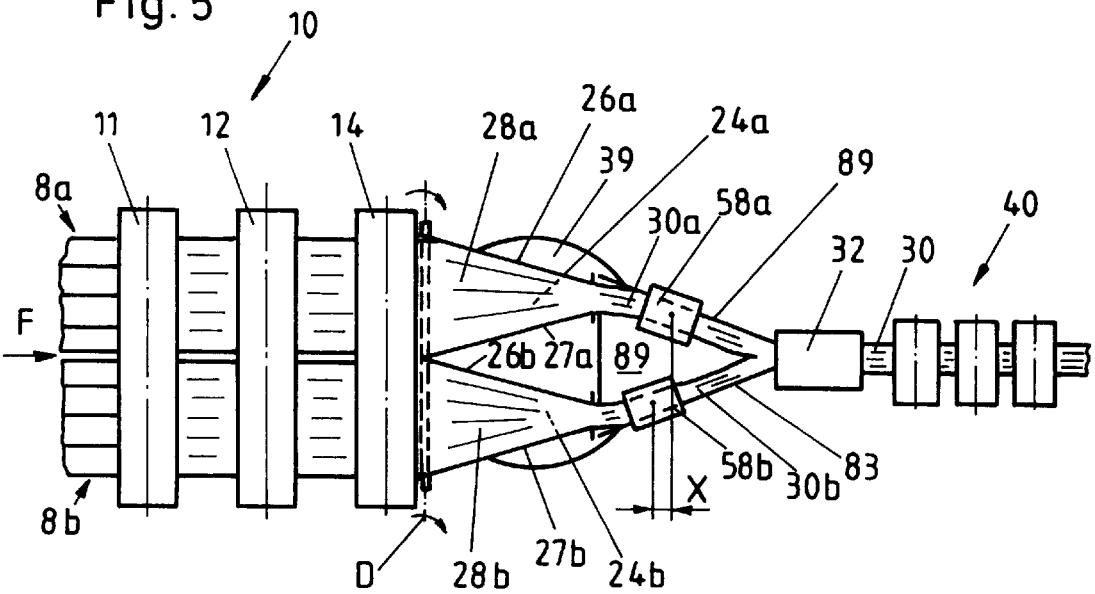
FIG. 5 shows a further embodiment pursuant to FIG. 2 with a separation apparatus for the fibre material.

FIG. 5 shows a further embodiment according to FIG. 4 in order to separate a reduced mass of fibre material from the normal conveying direction F. The fibre material supplied to the drafting arrangement 10 is delivered in form of two groups of slivers 8*a* and 8*b*. Each of the groups of slivers is provided with four slivers situated adjacent to one another. The groups of slivers 8*a* and 8*b* are drafted in the drafting arrangement 10 and supplied as fibre fleeces 28*a* and 28*b* which are situated adjacent to one another. These fibre fleeces are each joined by way of guide plates 24*a* and 24*b* with the help of lateral guide plates 26*a*, 27*a* and 26*b*, 27*b* into separate slivers 30*a* and 30*b*. The two slivers 30*a* and 30*b* are joined into a sliver 30 over a further guide plate 89 and under the influence of side plates 82 and 83 before entering a measuring member 32 which is situated downstream. The sliver 30 exiting from the measuring member is transferred to the drafting arrangement 40 which is provided downstream.

Figure 7:
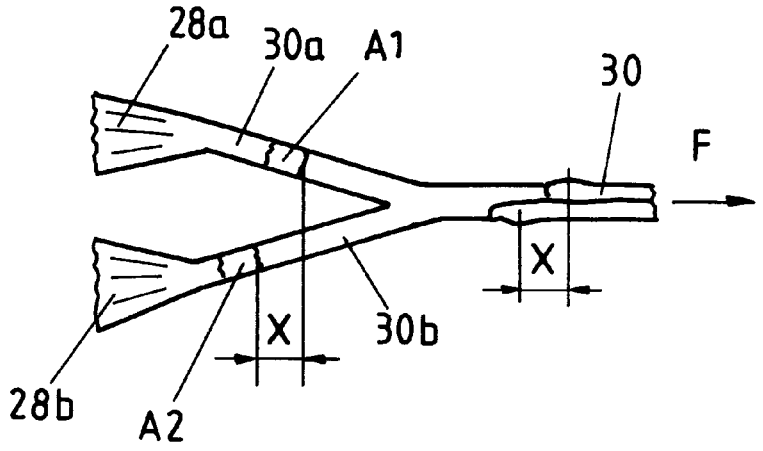
FIG. 7 shows a schematic representation of the piecing process according to the embodiment of FIG. 5.

A piecing apparatus 58*a* and 58*b* is provided in the conveying path of the individual slivers 30*a* and 30*b*. In the case of an interruption a newly supplied sliver is pieced with this piecing apparatus. The two piecing apparatuses 58*a* and 58*b* are arranged mutually offset by the amount X with respect to the conveying direction F. As a result of this and as is shown schematically in FIG. 7, the piecing places A1 and A2 are also displaced by the amount X with respect to the conveying direction F. In this way any fluctuations in the thickness with respect to sliver 30 occurring during the piecing process at the piecing places A1 or A2 are partly compensated. This means that an adverse piecing only has only half a disadvantageous effect with respect to the sliver 30.

In contrast to the embodiment of FIG. 4, in the embodiment of FIG. 5 the fibre material to be discharged is not discharged laterally, but downwardly into a can 39. In this process the guide plates 24*a* and 24*b*, including the lateral guide plates, are rotated downwardly about the rotational axis D. This swivelling can be made automatically by an apparatus (not shown), with the pivoting movement being limited in the downward direction. This means that as soon as the guide plates are situated in their lower position, the fibre material delivered by drafting arrangement 10 is discharged to the can 39. In the zone of the respective piecing apparatus 58*a* and 58*b* the trailing ends of the slivers 30*a* and 30*b* are ready for a piecing process. As soon as the supplied mass of the fibre material has reached $M_{setpoint}$ again, the guide plates 24*a* and 24*b* are pivoted back to their upper, approx. horizontal position again, as a result of which the piecing process can be made thereafter with the sliver ends of the slivers 30*a* and 30*b*. The drive of the second drafting arrangement 40 and the coiling apparatus 66, 68 and 69 is put back into operation again by the closure of coupling K.

With the device as proposed in accordance with the invention an apparatus is obtained which, on the one hand, ensures the production of a high-quality sliver and, on the other hand, prevents an interruption in the sliver which is deposited in can 64.

We claim:

1. An apparatus for forming a sliver comprising a first drafting arrangement having a plurality of pairs of rollers for drafting a sliver mass passing therethrough;

a measuring member downstream of said drafting arrangement for measuring the fiber mass of the sliver passing from said drafting arrangement and emitting a signal corresponding to the measured fiber mass;

a second drafting arrangement downstream of said measuring member for receiving the measured sliver therefrom, said second drafting arrangement having a plurality of pairs of rollers for drafting the sliver passing therethrough;

a first transmission for driving an output pair of said pairs of rollers of said first drafting arrangement and an input pair of said pairs of rollers of said second drafting arrangement;

a first servo-motor for driving said transmission;

a second transmission for driving an output pair of said pairs of rollers of said second drafting arrangement;

a second servo-motor for driving said second transmission;

a control unit operatively connected to said measuring member to receive and compare said signal with a predetermined set point value and to emit a control signal in response to a deviation of the received signal from said set point value, said control unit being operatively connected to said first servo-motor and said second servo-motor to deliver said control signal thereto to adjust each transmission to compensate for short-wave fluctuations in fiber mass and to effect the production of an even sliver; and a coiling apparatus for coiling the sliver from said second drafting arrangement into a storage means and a drive for driving said coiling apparatus, said drive being drivingly coupled with said first transmission.

2. An apparatus as set forth in claim 1 which further comprises a second measuring member for monitoring the sliver delivered from said second drafting arrangement, said second measuring member being disposed between said second drafting arrangement and said coiling apparatus.

3. An apparatus as set forth in claim 1 which further comprises a timing element in said control unit for interrupting operation of each drafting arrangement and said coiling apparatus in response to a deviation of the received signal from said set point value over a specific time period.

4. An apparatus for forming a sliver comprising a first drafting arrangement having a plurality of pairs of rollers for drafting a sliver mass passing therethrough;

a measuring member downstream of said drafting arrangement for measuring the fiber mass of the sliver passing from said drafting arrangement and emitting a signal corresponding to the measured fiber mass;

a second drafting arrangement downstream of said measuring member for receiving the measured sliver therefrom, said second drafting arrangement having a plurality of pairs of rollers for drafting the sliver passing therethrough;

a first transmission for driving an output pair of said pairs of rollers of said first drafting arrangement and an input pair of said pairs of rollers of said second drafting arrangement;

a first servo-motor for driving said transmission;

a second transmission for driving an output pair of said pairs of rollers of said second drafting arrangement;

a second servo-motor for driving said second transmission;

a control unit operatively connected to said measuring member to receive and compare said signal with a predetermined set point value and to emit a control signal in response to a deviation of the received signal from said set point value, said control unit being operatively connected to said first servo-motor and said second servo-motor to deliver said control signal thereto to adjust each transmission to compensate for short-wave fluctuations in fiber mass and to effect the production of an even silver; and a guide element between said drafting arrangements for selectively directing the sliver from said first drafting arrangement to a separation container.

5. An apparatus as set forth in claim 4 which further comprises an apparatus for piecing a new sliver end to a trailing sliver end between said guide element and said measuring member.

6. An apparatus for forming a sliver comprising a first drafting arrangement having a plurality of pairs of rollers for drafting a sliver mass passing therethrough;

a measuring member downstream of said drafting arrangement for measuring the fiber mass of the sliver passing from said drafting arrangement and emitting a signal corresponding to the measured fiber mass;

a second drafting arrangement downstream of said measuring member for receiving the measured sliver therefrom, said second drafting arrangement having a plurality of pairs of rollers for drafting the sliver passing therethrough;

a first transmission for driving an output pair of said pairs of rollers of said first drafting arrangement;

a first servo-motor for driving said transmission;

a second transmission for driving a pair of said pairs of rollers of said second drafting arrangement;

a second servo-motor for driving said second transmission;

a control unit operatively connected to said measuring member to receive and compare said signal with a predetermined set point value and to emit a control signal in response to a deviation of the received signal from said set point value, said control unit being operatively connected to said first servo-motor and said second servo-motor to deliver said control signal thereto to adjust each transmission to compensate for short-wave fluctuations in fiber mass and to effect the production of an even sliver; and a pair of piecing apparatus between said first drafting arrangement and said measuring member for receiving and joining individual slivers from said first drafting arrangement.

* * * * *